US005585123A

United States Patent [19]

Busby

[11] Patent Number: 5,585,123

[45] Date of Patent: Dec. 17, 1996

[54] SCULPTING TOOL

[76] Inventor: Philip J. Busby, 18216-D NW. Walker Rd., Beaverton, Oreg. 97006

[21] Appl. No.: 420,226

[22] Filed: Apr. 10, 1996

[51] Int. Cl.[6] ..... A63H 33/32

[52] U.S. Cl. ..... 425/276; 33/41.4; 294/51; 294/54.5; 425/281; 425/458; 446/70; 446/144

[58] Field of Search ..... 425/276, 281, 425/458, DIG. 57, 470; D21/120; D15/136; 446/70, 144; 294/51, 54.5, 55; 33/41.4

[56] References Cited

U.S. PATENT DOCUMENTS

| | | | |
|---|---|---|---|
| 457,271 | 8/1891 | Hall | 294/51 |
| 827,542 | 7/1906 | Lawson | 294/51 |
| 2,752,631 | 7/1956 | Wendt | 425/DIG. 57 |
| 3,279,397 | 10/1966 | Swett et al. | 425/458 |
| 3,434,232 | 3/1969 | Tarrson | 446/70 |
| 4,262,442 | 4/1981 | Mansfield | 425/DIG. 57 |
| 4,280,727 | 7/1981 | Germain | 294/54.5 |
| 4,346,885 | 8/1982 | Mathou | 4/488 |
| 4,455,752 | 6/1984 | Koulouras | 446/70 |
| 5,108,336 | 4/1992 | Rosier | 425/470 |

*Primary Examiner*—Robert Davis
*Attorney, Agent, or Firm*—Kolisch Hartwell Dickinson McCormack & Heuser

[57] ABSTRACT

A sculpting tool is provided for use in sculpting shapeable mass, such as common beach sand, snow, soft dirt or soft clay. The tool has first and second sculpting heads, each sculpting head having a pair of oppositely-facing cutting elements for cutting into the shapeable mass. The tool also has an elongate shaft or handle extending between the sculpting heads. Each cutting element is serrated so that a user may use the tool to produce patterns in the granular material. Preferably, each cutting element has a different serration pattern, thereby providing the user with four different patterns with which to sculpt. In addition, each sculpting head defines a pair of opposite cup-like structures such that a user may scoop and/or move a portion of the shapeable mass.

15 Claims, 1 Drawing Sheet

30
16
28
26
12
10
14
13
13
28
30
26
13
20
22
24

16a
16
28
14
18a
18

22
22a
28
20
24
24a 26
30
10
13
13
30
26
28
28
6
6
20
12
16

10
28
26
26
28
20
16
30
12
30

32
28
26
26
28
10
20
16
32
30
13
12
13
30
32

SULPTING TOOL

TECHNICAL FIELD

The present invention relates generally to hand tools, and more particularly, to tools which are used to from a shapeable mass. More particularly still, the invention relates to tools configured to sculpt or carve packed granular material such as sand. The invention is described in this context below.

BACKGROUND ART

From time immemorial, sand castles, sand sculptures and other sand structures have been a source of entertainment for enthusiasts, both young and old. Although such structures formerly were built exclusively for amusement and enjoyment, sand sculpting has become a serious commercial activity. Sculptures are created for competitions, for promotional purposes, as a vehicle for personal expression, and of course, just for fun. More and more, sand sculpting is becoming an activity driven by efficiency, skill and speed.

Previously, a sculptor could choose from a variety of tools to sculpt a shape, such tools serving primarily to cut or dig. Common tools have included hands, knives, spoons, cups, buckets and sand shovels. Several of the drawbacks common to these tools are: 1) the inability to form various desired shapes with a single tool; 2) the delay in switching from a shaping tool to a scooping tool; and 3) the inefficiency of most tools for use in creating conventional sand sculpture shapes.

Because loose, dry sand does not generally hold or retain its shape (i.e., loose, dry sand is not shapeable or shape-receptive) and packed, moist sand is shapeable or shape-receptive, sand structures generally are formed from packed, moist sand. Similar structures or shapes, however, can be created using any soft, shapeable mass, including, for example, materials such as snow, dirt, soft clay and moist sugar.

DISCLOSURE OF THE INVENTION

The present invention overcomes the drawbacks of existing sculpting tools by provision of a tool with an elongate handle which extends between opposite multi-purpose sculpting heads. The handle is in the form of an elongate shaft, preferably extending directly between the sculpting heads to provide the user with the ability to select rapidly a desired sculpting head. Each sculpting head has a pair of oppositely-facing cutting elements or blades for use in defining contours of the shapeable mass. Each cutting element is contoured differently from the others so that the user may produce various contour patterns. The sculpting heads also each define a cup-like structure such that the tool may be used both to scoop and carve.

The tool is suitable for use in sculpting any shapeable mass, but has proven particularly well-suited for use in sculpting a material such as common sand, snow, soft dirt or clay. The tool of this invention is useful in assisting an architect, builder, artist or sculptor in the creation of shapes or structures formed from sand. A user may, for example, use the invented tool to build a sand castle, dig a trench, form a sea wave pattern, or the like.

These and other objects and advantages of the present invention will be more readily understood after a consideration of the drawings and the detailed description of the preferred embodiment which follows.

DETAILED DESCRIPTION OF THE PREFERRED EMBODIMENT AND BEST MODE FOR CARRYING OUT THE INVENTION

A preferred embodiment of the sculpting tool is shown in FIGS. 1 through 6, such tool being indicated generally at 10. As shown, the tool includes an elongate shaft or handle 12 which extends between a pair of opposite sculpting heads 14, 20, the handle 12 being of a size and shape to accommodate grasping by either small or large human hands. Preferably, the handle is approximately 5-inches long, ¾-inch wide and ¾-inch thick. The handle thus may be gripped and easily manipulated by users of different dexterity and size.

In the preferred embodiment tool, handle 12 defines a skeleton with a plurality of ribs 13 configured to provide the tool with structural support. These ribs extend between a pair of elongate spines, each of which extends the length of the handle to support the opposite sculpting heads. The spines and ribs collectively define passageways through the handle whereby sand and water may pass therethrough.

Figure 1:
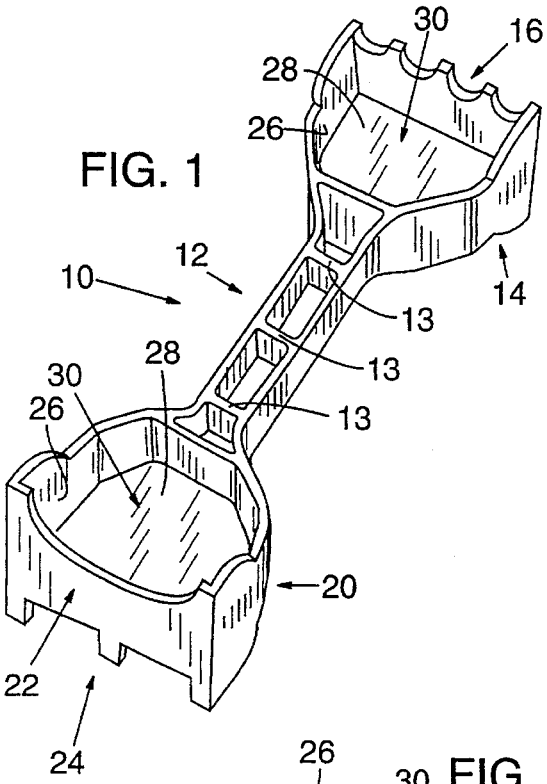
FIG. 1 is an isometric view of a sculpting tool formed in accordance with a preferred embodiment of the invention.
Figure 2:
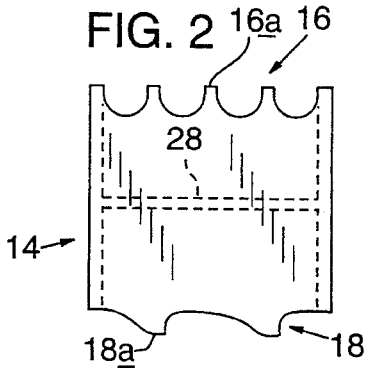
FIG. 2 is a front elevational view of the sculpting tool shown in FIG. 1, a first sculpting head with first and second different serration patterns being illustrated.
Figure 3:
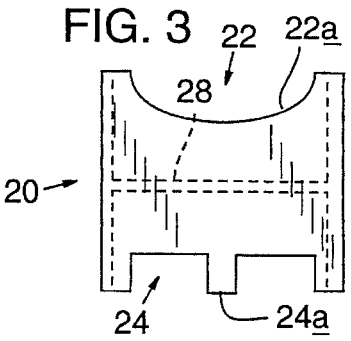
FIG. 3 is a rear elevational view of the sculpting tool shown in FIG. 1, a second sculpting head with third and fourth different serration patterns being illustrated

As should be apparent, a sculpting head is located on each end of handle 12, each sculpting head being configured variously to carve, move, scoop, or otherwise manipulate sand. In accordance with my teachings, each sculpting head has a pair of oppositely facing cutting elements or blades, each defining a different contour for cutting, sculpting, digging or carving the sand. As shown in FIG. 2 first sculpting head 14 includes a first cutting element 16 and an oppositely-facing second cutting element 18. In FIGS. 1 and 3 second sculpting head 20 will be seen to include a third cutting element 22 and an oppositely-facing fourth cutting element 24. Each cutting element has a corresponding contour, or serration pattern **16*a*, 18*a*, 22*a*, 24*a*, each such pattern being different from the other serration patterns of the tool. In the preferred embodiment, the serration pattern of the cutting elements 16 is defined by plural half-circles 16*a*, the serration pattern of cutting element 18 is defined by a wave-like outline 18*a*. The serration pattern of cutting element 22 is defined by a single broad half-circle 22*a*, and the serration pattern of cutting element 24 is defined by plural rectangular channels 24*a***. Of course, these patterns are only examples of the many types of serration patterns that the cutting elements may define. Those skilled in the art, in fact, will appreciate that the serration pattern of the cutting elements will vary in accordance with the particular effect which is desired. Using the sculpting heads of the invented tool, a user thus can quickly create a variety of shapes, contours and structures limited primarily only by the user's imagination and by the structural limitations of the sand.

Figure 4:
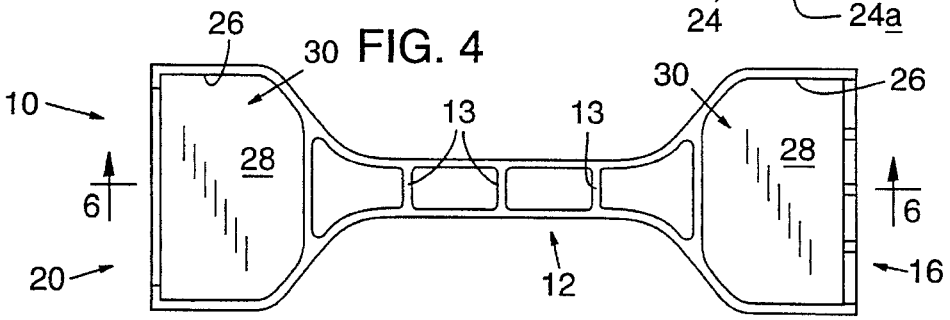
FIG. 4 is a top plan view of the sculpting tool of FIG. 1.
Figure 5:
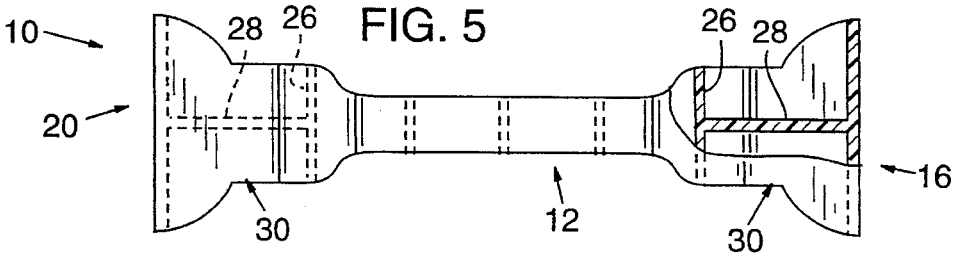
FIG. 5 is a left side elevational view of the sculpting tool of FIG. 1, the view being particularly sectioned to illustrate skeletal structure of the tool.
Figure 6:
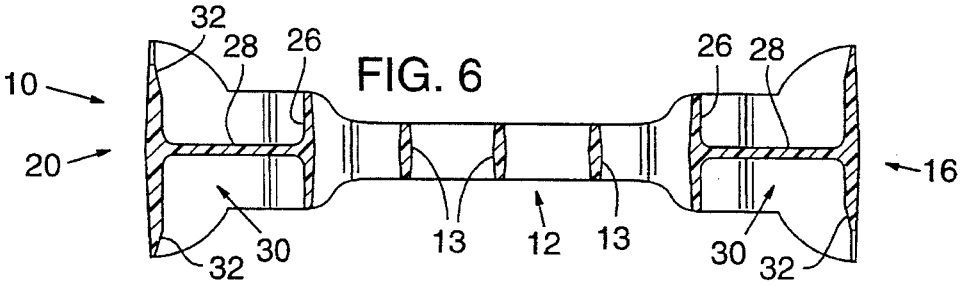
FIG. 6 is a side sectional view of a sculpting tool formed in accordance with an alternative embodiment of the invention.

As shown in FIGS. 1 and in FIGS. 4 through 6, each sculpting head includes a plurality of walls 26 and a floor 28 which collectively define an open, cup-like structure 30 in connection with each cutting element. FIG. 5 shows a side view of the tool with ribs 13, walls 26 and floor 28 shown primarily in phantom (first sculpting head 16 is partially sectioned to show walls 26 and floor 28). In the preferred embodiment, it will be noted that floor 28 is located between the opposite edges of walls 26 so as to define a pair of oppositely-facing open, cup-like structures which may be used to scoop sand in both directions upon reciprocating motions of the user's hand. Similarly, it is to be noted that either the first sculpting head or the second sculpting head may be selected to use simply by wrist action of the user. Also, it will be noted that each cup-like structure has a depth on all four sides to provide for scooping of even fluid materials such as water or the like.

The preferred sculpting tool is approximately nine-inches in length. Each head is approximately three-inches wide. The tool may be formed from any suitable material that is sufficiently rigid and non-corrosive for use with wet sand. Materials such as plastic have been found particularly well-suited for use in this regard.

FIG. 6 shows an alternative embodiment tool in a section to illustrate tapered edge 32 of each cutting element. Those skilled will appreciate that better defined shapes or edges can be achieved by the use of cutting elements which have tapered edges such as those shown. Without changing tools, the user can create a shape in the sand with one serration pattern and then quickly change to another serration pattern to modify that shape or to create a different shape nearby. The user similarly may create a shape in the sand and then quickly scoop up some extra or unnecessary sand, all with a simple flip of the wrist. Since the tool provides the function of multiple sculpting tools, the user can avoid purchasing, hauling and searching through a pile of existing tools. Therefore, the user may create a shape, form, structure, etc. in sand using one main tool, thereby to finish the task sooner and with less effort.

It will be understood that the sculpting tool is suited for use in sculpting various materials, but that it has proven especially well-suited for use in shaping granular material wherein the granules have some sort of affinity towards one another similar to that of packed, moist sand. Other suitable materials include snow, dirt, soft clay and moist sugar. Any reference to sand, snow, dirt, etc. in this description thus will be understood to encompass any shapeable mass which may be sculpted or molded in a manner similar to moist sand.

While the present invention has been shown and described with reference to the foregoing operational principles and preferred embodiment, it will be apparent to those skilled in the art that various changes in form and detail may be made without departing from the spirit and scope of the invention as defined by the appended claims.

I claim:

1. A tool for use in sculpting a shapeable mass, the tool comprising:

first and second sculpting heads, each including a pair of oppositely-facing cutting elements with predetermined sculpting contours, and an elongate gripable handle extending between said sculpting heads to provide for rapid selection between cutting elements and sculpting heads.

2. The tool of claim 1, wherein each cutting element defines a different sculpting contour.

3. The tool of claim 1, wherein each sculpting head defines a cupped structure configured to scoop a portion of the shapable mass.

4. The tool of claim 1, wherein each sculpting head defines a pair of oppositely-facing cupped structures.

5. The tool of claim 4, wherein each cupped structure is defined at least partially by one or more of said cutting elements.

6. A hand-held tool for use in sculpting a shapeable mass of granular material with granules having an affinity toward one another, the tool comprising:

first and second sculpting heads, each sculpting head including a pair of oppositely-facing cutting elements, each cutting element defining a different predetermined serration pattern, and an elongate handle extending between said sculpting heads, said handle being configured for hand gripping so that a user may select between use of said first sculpting head or said second sculpting head by a turn of the wrist.

7. The tool of claim 6, wherein at least one of said predetermined serration patterns is a wave-shaped pattern.

8. The tool of claim 6, wherein at least one of said predetermined serration patterns is a plurality of half-circles.

9. The tool of claim 6, wherein at least one of said predetermined serration patterns is a single broad half-circle.

10. The tool of claim 6, wherein at least one of said predetermined serration patterns is a plurality of rectangular channels.

11. The tool of claim 6, wherein each sculpting head defines an cupped structure configured to scoop such shapable mass.

12. The tool of claim 6, wherein each sculpting head defines a pair of oppositely-facing cupped structures.

13. The tool of claim 12, wherein each cupped structure includes a side wall defined at least partially by one or more of said cutting elements.

14. A hand-held sand sculpting tool comprising:

first and second sculpting heads, each including a pair of oppositely-facing cupped structures configured to scoop sand and a pair of oppositely-facing cutting elements configured to contour sand, each cutting element having a different predetermined serration pattern, and an elongate handle which extends between said sculpting heads, said handle being configured for hand gripping such that a user may select between cutting elements by a turn of the wrist.

15. The tool of claim 14, wherein each cutting element at least partially defines a different cupped structure.

* * * * *

UNITED STATES PATENT AND TRADEMARK OFFICE

CERTIFICATE OF CORRECTION

PATENT NO. : 5,585,123

DATED : December 17, 1996

INVENTOR(S) : Philip J. Busby

It is certified that error appears in the above-indentified patent and that said Letters Patent is hereby corrected as shown below:

On page 1, the filing date should be changed from "April 10, 1996" to read --April 10, 1995--.

Signed and Sealed this

Thirtieth Day of September, 1997

*Attest:*

*Attesting Officer*

BRUCE LEHMAN

*Commissioner of Patents and Trademarks*